US005357697A

United States Patent [19]

Lin

[11] Patent Number: 5,357,697

[45] Date of Patent: Oct. 25, 1994

[54] SAFETY ILLUMINATED SHOE

[76] Inventor: Wen-Tsung Lin, P.O. Box 74-9, Taipei, Taiwan

[21] Appl. No.: 194,395

[22] Filed: Feb. 10, 1994

[51] Int. Cl.[5] ..... A43B 23/00; F21L 15/08

[52] U.S. Cl. ..... 36/137; 362/103

[58] Field of Search ..... 36/137; 362/103

[56] References Cited

U.S. PATENT DOCUMENTS

| | | | |
|---|---|---|---|
| 1,933,243 | 10/1933 | De Merolis et al. | 36/137 X |
| 3,800,133 | 3/1974 | Duval | 36/137 X |
| 4,014,115 | 3/1977 | Reichert | 36/137 |
| 4,253,253 | 3/1981 | McCormick | 36/137 |
| 5,303,131 | 4/1994 | Wu | 36/137 |

FOREIGN PATENT DOCUMENTS

| | | | |
|---|---|---|---|
| 0246634 | 9/1925 | Australia | 36/137 |

*Primary Examiner*—Paul T. Sewell
*Assistant Examiner*—Ted Kavanaugh

[57] ABSTRACT

A safety illuminated shoe includes a plurality of illuminators secured on a printed circuit board having a flip-flap trigger switch mounted on the printed circuit board and electrically connected between two poles of a power source of batteries packed under the printed circuit board for supporting the printed circuit board, whereby upon treading of the shoe to close two contacts of the flip-flap trigger switch, the illuminators will be lit up for a predetermined time period as controlled by an integrated circuit built on the printed circuit board, and since the two contacts of the flip-flap switch are normally restored by its self resilience and can then be separated each other to prevent unexpected power consumption of the batteries.

1 Claim, 2 Drawing Sheets

SAFETY ILLUMINATED SHOE

BACKGROUND OF THE INVENTION

U.S. Pat. No. 4,128,861 to Pelengaris disclosed an illuminated shoe having a plurality of lamps 38 provided in a hollow heel having lens 22 removably secured in the heel, and the lamps 38 are switched on when the resilient pad 23 is under pressure to close the two electric contacts 30, 32. However, during the handling or transportation of new shoes as packed in shoe cases, the vibrations of the shoes may urge the resilient pad 23 of each shoe to consume power of the batteries 29, which may even be exhausted, thereby being unable to light up the lamps when used.

It is therefore desired to invent an illuminated shoe with stable handling condition without consuming power unexpectedly.

SUMMARY OF THE INVENTION

The object of the present invention is to provide a safety illuminated shoe including a plurality of illuminators secured on a printed circuit board having a flip-flap trigger switch mounted on the printed circuit board and electrically connected between two poles of a power source of batteries packed under the printed circuit board for supporting the printed circuit board, whereby upon treading of the shoe to close two contacts of the flip-flap trigger switch, the illuminators will be lit up for a predetermined time period as controlled by an integrated circuit built on the printed circuit board, and since the two contacts of the flip-flap switch are normally restored by its self resilience and can then be separated each other to prevent unexpected power consumption of the batteries.

DETAILED DESCRIPTION

Figure 1:
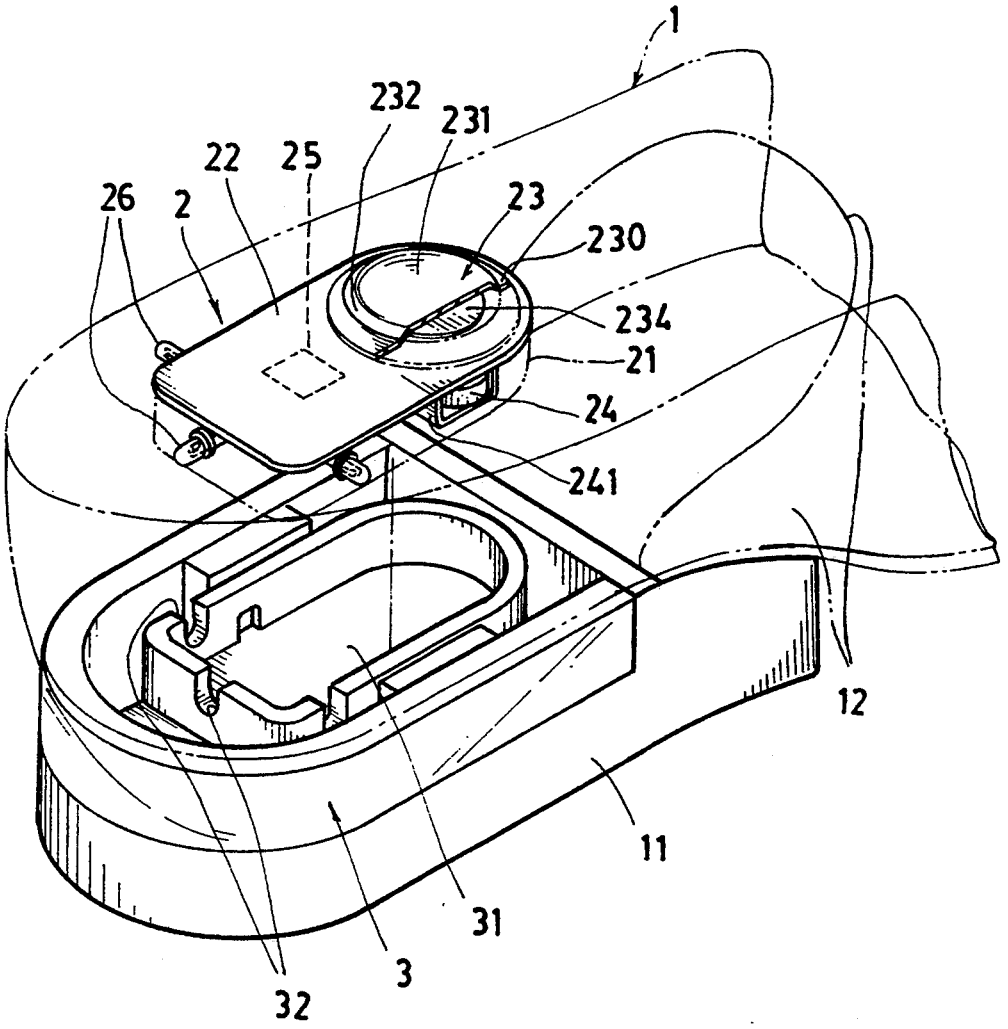
FIG. 1 is an exploded view of the present invention.
Figure 2:
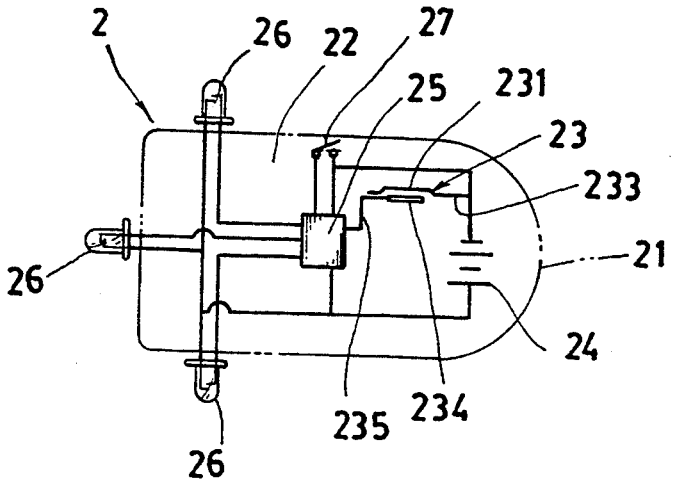
FIG. 2 is a circuit diagram of the present invention.

As shown in the drawing figures, the present invention comprises: a shoe 1 having an illuminating means 2 embedded in a transparent holder 3 secured in a heel 11 of the shoe 1 for safety illuminating purpose.

The shoe 1 designated in this invention may be referred to any kinds of footwears, sport shoes, slippers, sandals, and so on.

The illuminating means 2 is detachably embedded in an inner socket 31 of the transparent holder 3 having a plurality of illuminator clips 32 circumferentially formed on the holder 3 for holding a plurality of illuminators 26 of the illuminating means 2 which is covered by an insole 12 of the shoe 1. The transparent holder 2 is secured in a rear recess 111 recessed in the heel 11 of the shoe 1 to be adjacent to an insole 12 formed inside the upper 10 of the shoe 1. The illuminators 26 may be bulbs, LEDs, etc.

The illuminating means 2 includes: a housing 21, a printed circuit board 22 secured in an upper portion of the housing 21, a flip-flap trigger switch 23 mounted on the printed circuit board 22, a plurality of batteries 24 (which may be button cells held in a battery bracket 241) secured on the printed circuit board 22, an integrated circuit 25 and a plurality of illuminators 26 secured on the printed circuit board 22 with the integrated circuit 25 for timing control of the illumination of the illuminators 26 when actuating the flip-flap trigger switch 23. An on-off switch 27 may be provided in the illuminating means 2 serving as a main switch for on-off control of the power source of the batteries 24.

Figure 3:
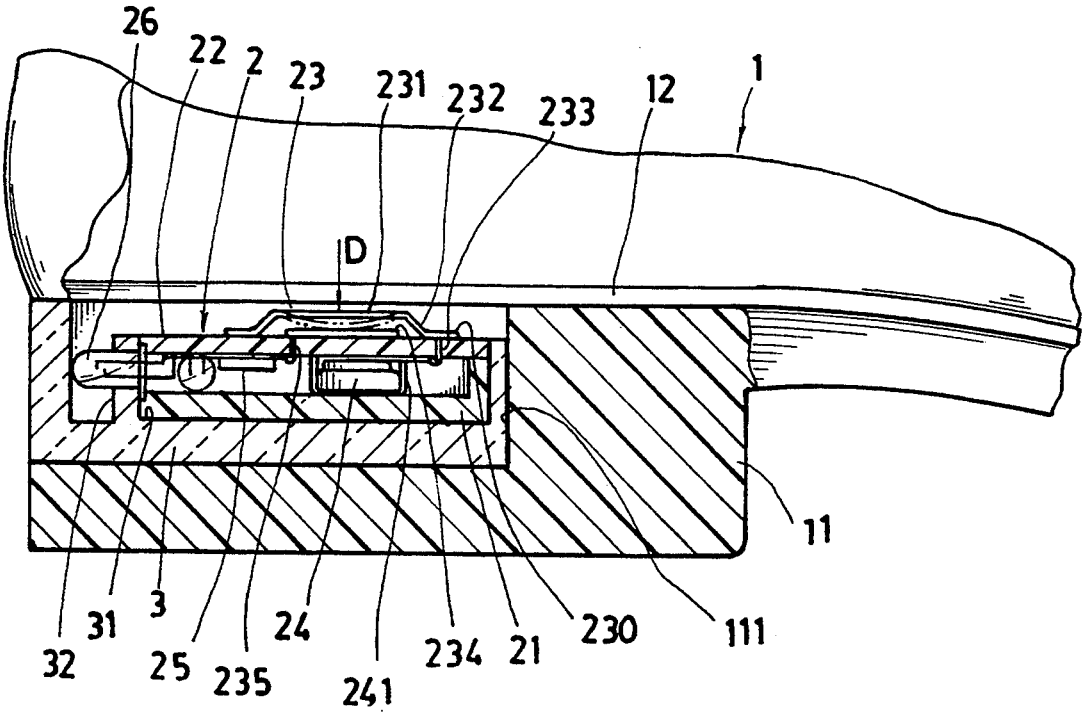
FIG. 3 is a partial sectional drawing of the present invention.

The flip-flap trigger switch 23 of the illuminating means 2 includes: a base flange 230 secured on the printed circuit board 22, an upper disk portion 231 made of electrically conductive material and connected with the base flange 230 by a shallow conical wall 232 generally formed as truncated cone shape with the shallow conical wall 232 protruding and tapered upwardly from the base flange 230 to be connected with the upper disk portion 231 generally horizontally flattened, a first leading wire 233 connected between the upper disk portion 231 and a first pole of the batteries 24 which are secured under the printed circuit board 22 for supporting the printed circuit board, a lower contactor plate 234 secured on the printed circuit board 22 and positioned under the upper disk portion 231 and electrically connected to a second pole of the batteries 24 by a second leading wire 235, whereby upon depression of the upper disk portion 231 (D) as shown in FIG. 3 such as trodden by a user's foot on the insole 12 of the shoe to close the upper disk portion 231 with the lower contactor plate 234, the illuminators 26 will be powered and lit on by the batteries 24 for safety illumination through the transparent holder 3 in the heel 11 of the shoe 1.

Since the upper disk portion 231 of the flip-flap switch 23 is resiliently restored upwardly to be always separated from the lower contactor plate 234 once releasing the pressure on the shoe insole 12 or the upper disk portion 231 of the switch 23, the batteries 24 will not accidentally or unexpectedly consume their power energy, ensuring a reliable illuminating purpose for the shoes of this invention.

The batteries 24 packed under the printed circuit board 22 may well support the board 22 without being easily damaged or broken when subjected to pressure of a wearer's body weight.

Figure 4:
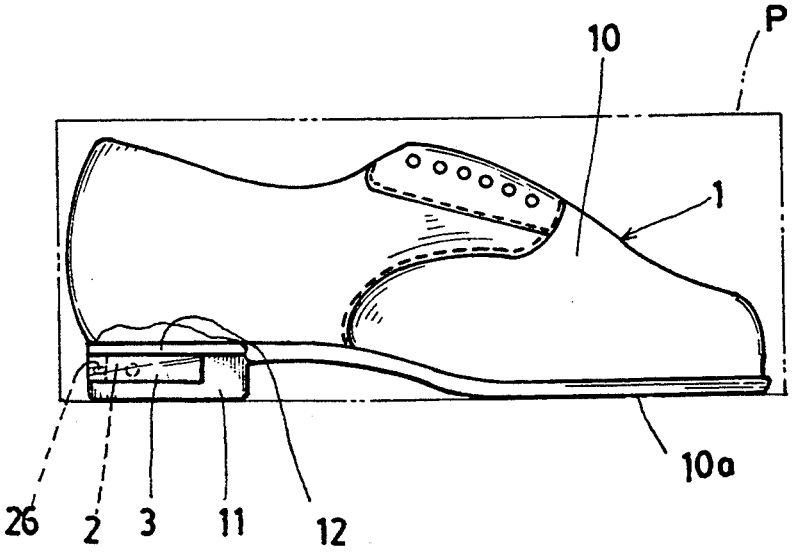
FIG. 4 is an illustration showing a stable handling of the present invention.

When the shoe 1 is packed in a package case P as shown in FIG. 4, the shoe 1 is held in the case P by retaining the upper 10 and the shoe 10*a* and heel 11 within the case P so that the flip-flap trigger switch 23 will not be accidentally pressurized to prevent electrical contacting of the two contacts 231, 234 in the switch to prevent power consumption of the batteries 24.

Accordingly, this invention is safer and more useful than a conventional illuminated shoe such as disclosed in U.S. Pat. No. 4,128,861.

Although the illuminating means 2 of this invention is inserted in the shoe heel, it however can also be inserted in other locations in a sole or a shoe, not limited in this invention.

I claim:

1. A safety illuminated shoe comprising:

a shoe (1) having a transparent holder (3) secured in a rear recess in a heel of the shoe; and an illuminating means (2) detachably embedded in an inner socket (31) of the transparent holder (3) having a plurality of illuminator clips (32) circumferentially formed on the holder (3) for holding a plurality of illuminators (26) of the illuminating means (2), said illuminating means being covered by an insole (12) inside an upper of the shoe;

said illuminating means (2) including: a housing (21), a printed circuit board (22) secured in an upper portion of the housing (21), a flip-flap trigger switch (23) mounted on the printed circuit board (22), a plurality of batteries (24) secured on the printed circuit board (22), an integrated circuit (25) and a plurality of said illuminators (26) secured on the printed circuit board (22) with the integrated circuit (25) for timing control of illumination of the illuminators (26) when actuating the flip-flap trigger switch (23);

the improvement which comprises:

said flip-flap trigger switch (23) of the illuminating means (2) including: a base flange (230) secured on the printed circuit board (22), an upper disk portion (231) made of electrically conductive material and connected with the base flange (230) by a shallow conical wall (232) generally formed as truncated cone shape with the shallow conical wall (232) protruding and tapered upwardly from the base flange (230) to be connected with the upper disk portion (231) generally horizontally flattened, a first leading wire (233) connected between the upper disk portion (231) and a first pole of the batteries (24) which are secured under the printed circuit board (22) for supporting the printed circuit board, a lower contactor plate (234) secured on the printed circuit board (22) and positioned under the upper disk portion (231) and electrically connected to a second pole of the batteries (24) by a second leading wire (235), whereby upon depression of the upper disk portion (231) as trodden by a user's foot on the insole (12) of the shoe to close the upper disk portion (231) with the lower contactor plate (234), the illuminators (26) will be powered and lit on by the batteries (24) for safety illumination through the transparent holder (3) fixed in the heel (11) of the shoe (1).

* * * * *